United States Patent [19]

Buck

[11] Patent Number: 4,801,104

[45] Date of Patent: Jan. 31, 1989

[54] LINEAR TRAVEL WINDUP

[75] Inventor: Rufus E. Buck, Grimesland, N.C.

[73] Assignee: E. I. Du Pont de Nemours and Company, Wilmington, Del.

[21] Appl. No.: 104,109

[22] Filed: Oct. 5, 1987

[51] Int. Cl.[4] ..... B65H 54/20; B65H 54/52

[52] U.S. Cl. ..... 242/35.5 R; 242/18 DD; 242/65

[58] Field of Search ..... 242/35.5 R, 18 DD, 65, 242/18 A

[56] References Cited

U.S. PATENT DOCUMENTS

| | | | |
|---|---|---|---|
| 3,628,741 | 12/1971 | Enneking et al. | 242/18 DD |
| 3,642,217 | 2/1972 | Sistare et al. | 242/18 DD X |
| 3,697,007 | 10/1972 | Taylor et al. | 242/18 DD |
| 3,876,161 | 4/1975 | Miller | 242/18 A |
| 4,009,839 | 3/1977 | Bense | 242/18 DD |
| 4,186,890 | 2/1980 | Miller | 242/18 A |
| 4,304,364 | 12/1981 | Busch | 242/18 DD |
| 4,524,918 | 6/1985 | Feusi et al. | 242/18 A |

FOREIGN PATENT DOCUMENTS

| | | |
|---|---|---|
| 2310202 | 12/1976 | Fed. Rep. of Germany . |
| 2532165 | 4/1979 | Fed. Rep. of Germany . |
| 598826 | 3/1978 | U.S.S.R. . |

*Primary Examiner*—Stanley N. Gilreath

[57] ABSTRACT

A modified windup in which package supports move in a linear motion as packages build on chucks in surface-driven engagement with drive roll. Fluid cylinders moving the chucks are connected via a hydraulic loop permitting free flow of fluid between the cylinders as yarn packages are wound thereby utilizing counter-balancing package weights for controlling force between the chucks and the drive roll.

2 Claims, 3 Drawing Sheets

LINEAR TRAVEL WINDUP

BACKGROUND OF THE INVENTION

This invention relates generally to the packaging of yarn and, more particularly, to the equipment with which yarn advancing continuously from a source is wound on packages.

Windups which include a print roll or drive roll to which yarn advances from a reciprocating traverse guide and from which the yarn is deposited on a surface-driven package are in wide use. Generally, these windups are for winding rather small light-weight packages wherein the traverse mechanism and drive roll are fixed and upper and lower packages move about pivots as they build on their respective supports. In such configurations, the size of the package is limited by machine dimensions but even when such dimensions permit a somewhat larger package to be wound the greater weight as the package winds creates undesirable vibrational movement between the drive roll and the package which in turn results in pressure variations being introduced into the package as it is being wound thus creating a less uniform yarn product. A windup for winding large heavy weight packages is shown in U.S. Pat. No. 4,009,839, wherein the chucks holding the package supports are cantilevered from the frame of the machine and the traverse mechanism and the drive roll are mounted on a carrying unit or slide carriage. This arrangement has proven somewhat successful in reducing undesirable pressure variations that are introduced into the package as the package builds. However, the use of such windups require a complete replacement of existing windups which is costly.

SUMMARY OF THE INVENTION

To accommodate winding large heavy packages on existing windups with a uniform package force, the windup has been modified to move the chucks carrying the package supports toward and away from engagement with the drive roll in separate angularly displaced planes that intersect each other at the central axis of the drive roll and means are provided to balance one package weight against the other to control the force on the chucks. The means for counterbalancing chuck force is a hydraulic system connected between the upper and lower hydraulic cylinders which control movement of the chucks.

BRIEF DESCRIPTION OF THE DRAWINGS

FIG. 3 is a schematic view of the hydraulic system of this invention.

DETAILED DESCRIPTION OF THE ILLUSTRATED EMBODIMENT

Figure 1:
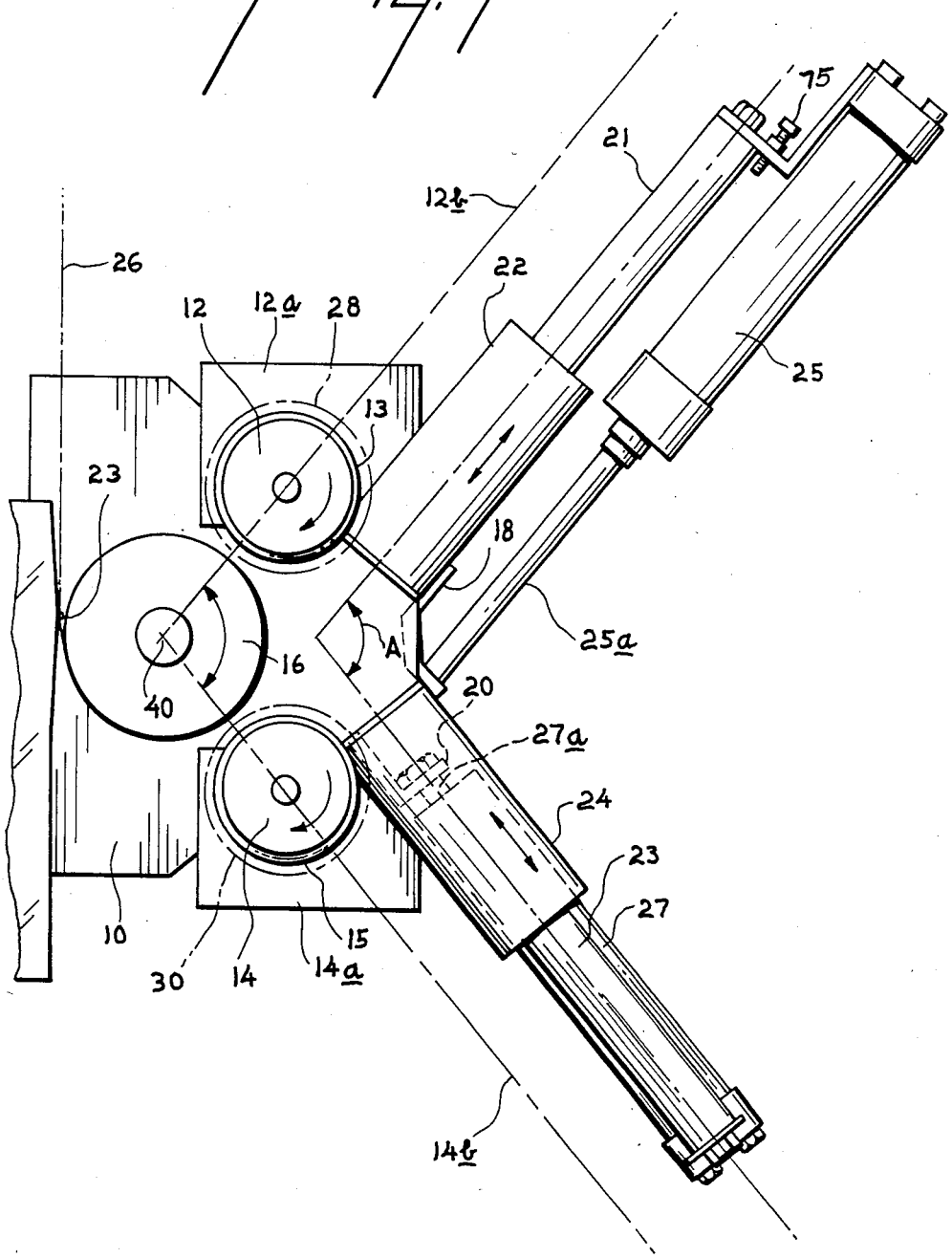
FIG. 1 is a front view of the windup.
Figure 2:
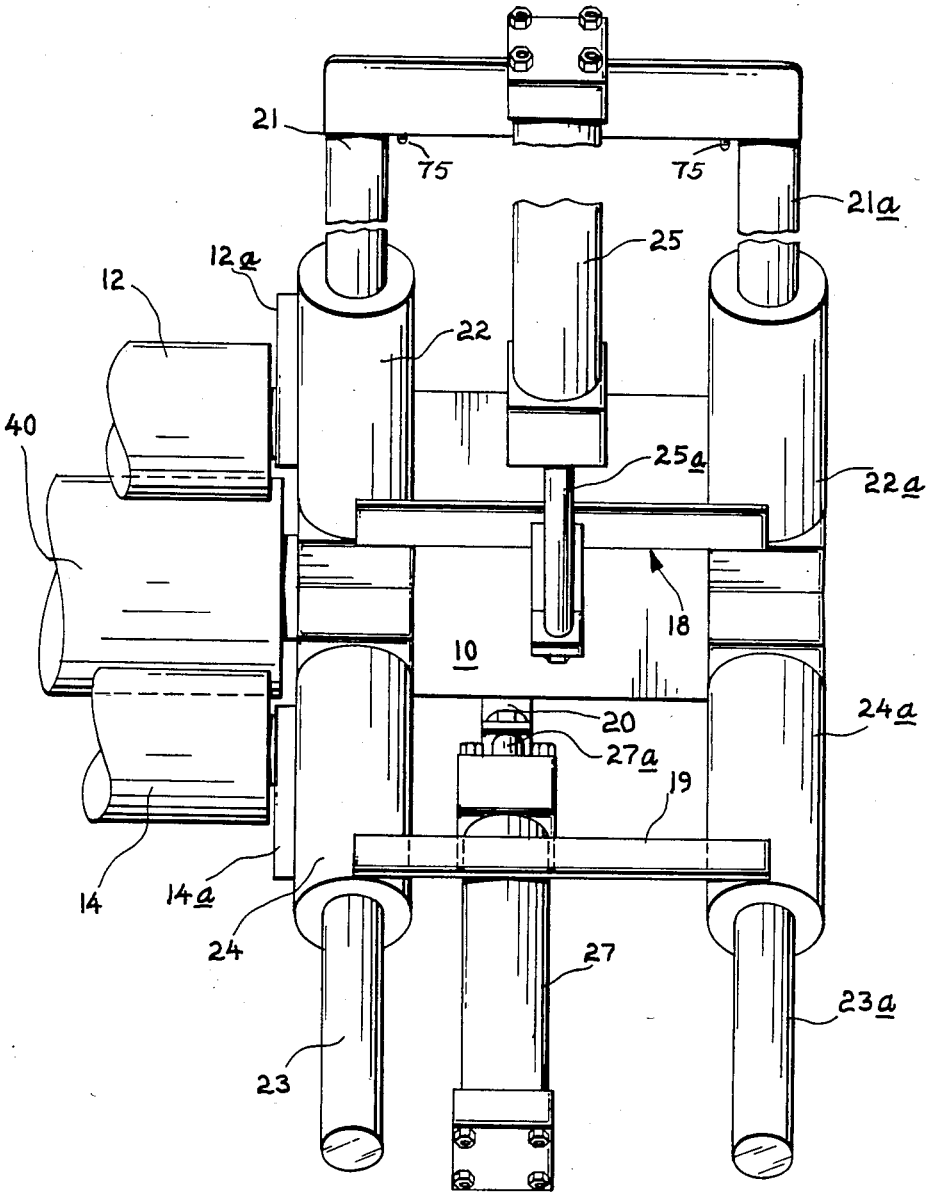
FIG. 2 is a side view of the windup.
Figure 1:
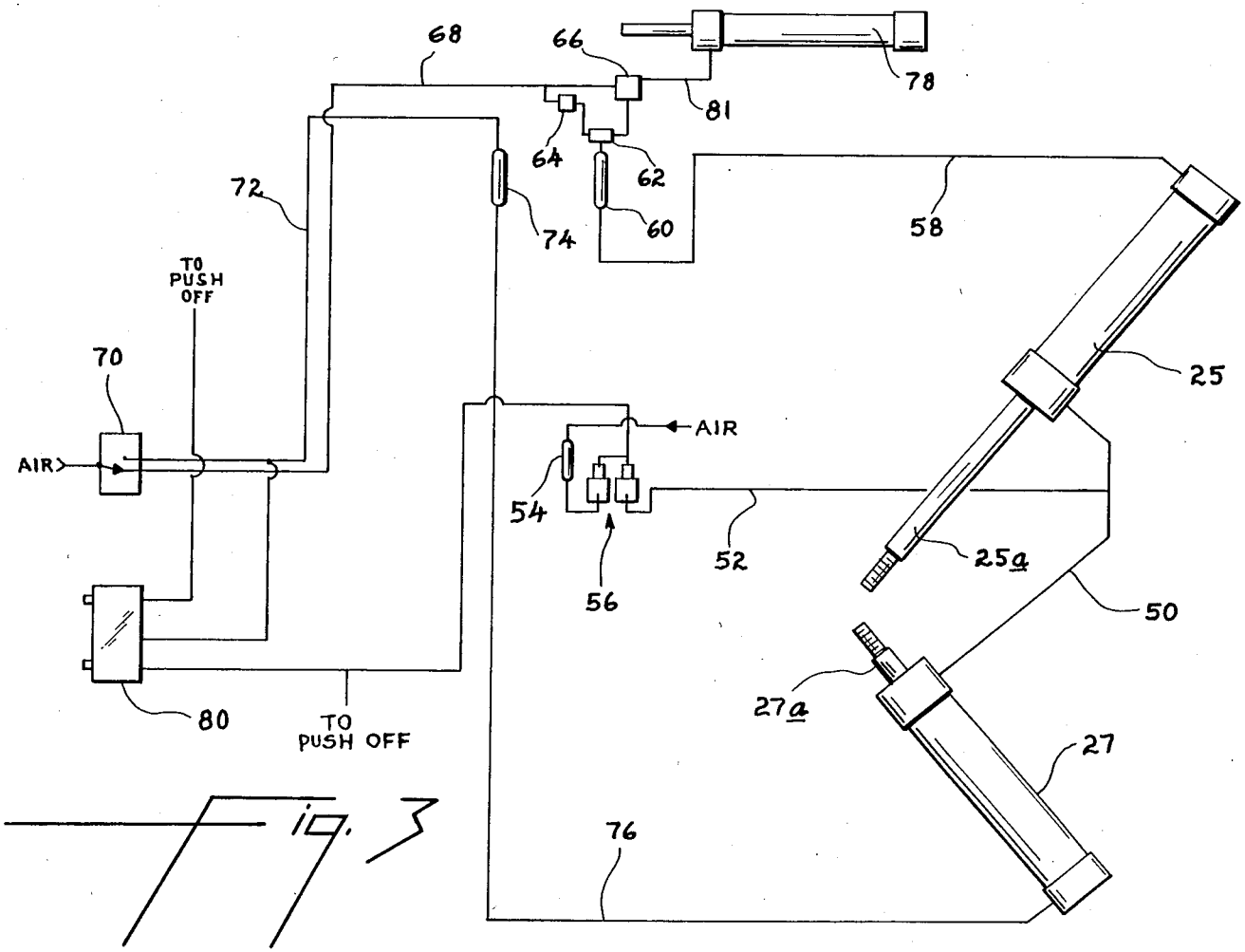

Referring to FIGS. 1 and 2, it will be seen that the embodiment chosen for purposes of illustration includes generally, as components thereof, an equipment frame 10, upper and lower rotatable chucks 12, 14 respectively, mounted for relative linear movement toward and away from surface driven engagement with a drive roll 16 rotatably mounted to the frame, and a reciprocating traverse guide 23 through which yarn 26 passes under drive roll 16 to package supports 13,15 on chucks 12,14 to build packages 28,30. Means for mounting the chucks for linear movement includes linear motion bearings 22, 22*a*, 24, 24*a*, movable on respective bearing posts 21, 21*a*, 23, 23*a*. Bearing posts 21, 21*a*, 23, 23*a*, are connected at one end to frame 10. Bearing posts 21, 23 and 21*a*, 23*a* are angularly displaced by an angle A. Bearing posts 21, 21*a* are connected at their other ends to cylinder 25 while the other ends of bearing posts 23, 23*a* are open ended. The motion bearings are fixed to chucks 12, 14. A support 18 is connected between the end of the shaft 25*a* of hydraulic cylinder 25 and the bearings 22, 22*a*. A support 20 is joined to shaft 27*a* of hydraulic cylinder 27 and frame 10. A support 19 connects cylinder 27, and bearings 24, 24*a*. In this manner the chucks 12,14 carried by supports 12*a*, 14*a* and the respective bearings 22,24 to which they are attached are movable along bearing posts in separate planes designated 12*b*, 14*b* (FIG. 1) and which intersect each other at location 40 at the central axis of the drive roll 16. The planes 12*b*, 14*b*, are parallel to bearing posts 21,23 respectively, and are angularly displaced from each other by the same angle as the bearing posts 21,23 are displaced from each other.

The hydraulic system is best shown in FIG. 3 which is a piping schematic of the system wherein hydraulic cylinders 25,27 are connected together at one end by a pipe 50 which in turn is connected to a pressurized air supply via pipe 52. A hydraulic reservoir 54 (Model No. 2485-AG, Bimba Mann Co., Monee, IL) and an actuator 56 (Part MPA P-3, Clippard Instrument Laboratory, Inc., Cincinnati, OH 45239) are serially connected in pipe 52 between the pressurized air supply and the cylinders 25,27. The other end of cylinder 25 is connected via pipe 58 to one end of hydraulic reservoir 60. The other end of the reservoir 60 is connected to a shuttle valve 62 (Part No. MJ SV-1, Clippard Instrument Laboratory, Inc.) which is in turn connected to a parallel arrangement of a regulator 64 (Type 10 regulator, Bellofram, Burlington, MA) and a pulse valve 66 (Part No. PV-1P, Clippard Instrument Laboratory, Inc.) which in turn is then connected to pressurized air supply via pipe 68 and toggle valve 70. The toggle valve 70 also (depending on its position) supplies pressurized air via pipe 72 to hydraulic reservoir 74 which is connected to the end of air cylinder 27 via pipe 76. An adjustable-volume reservoir 78 (air cylinder Model No. 17-4-D, Bimba Mann Co., Monee, Ill.) is connected to pulse valve 66 via pipe 81.

In operation, stringup is initiated when an operator actuates toggle valve 70. Assuming the chucks 12,14 are in the doff position, actuating this toggle switch sends 100 psi air through pipe 68 to a pulse valve 66 and shuttle valve 62 into hydraulic reservoir 60. Liquid in the reservoir is caused to flow into the non-shaft end of the cylinder 25. This fluid transfer causes the cylinder shaft 25*a* to extend, moving the chucks 12 to the drive roll 16 for stringup (FIG. 1). Simultaneously, fluid from the shaft end of cylinder 25 moves via pipe 50 to the shaft end of cylinder 27, forcing the shaft 27*a* to retract and thereby moving lower chuck 14 to tee drive roll 16 for stringup. When the further movement of the chuck is restricted by its contact with the drive roll, pressure builds up in the adjustable reservoir 78 actuating the pulse valve 66 which shifts the shuttle valve 62, shutting off line pressure and opening the regulator 64 leg, by which relatively low pressure is maintained on the chucks during yarn winding to provide constant positive trim force.

When packages 28,30 are wound to the desired size, they are doffed by a push-off mechanism (not shown) actuated by air pressure supplied from line 72 when valve 80 is actuated. Valve 80 (Valve MJV-3NC, Clippard Instrument Laboratory, Inc.) also actuates valves 56. This procedure begins with moving toggle valve 70 to its alternate position feeding line air pressure into pipe 72 to exert itself on a hydraulic reservoir 74; resulting fluid flow from the reservoir 74 through pipe 76 to the non-shaft end of the cylinder 27, causing its shaft to extend, moving the chucks outward relative to the drive roll for braking and doffing. Line pressure is maintained until the toggle valve 70 is moved back to the string-up position.

A totally separate primary hydraulic circuit connects the upper and lower cylinders 25,27 causing motion of either chuck to be replicated in the other. This circuit consisting of lines 50,52, valves 56 and hydraulic reservoir 54 in conjunction with the symmetrical cylinder location enables winding upper and lower packages to counterbalance each other as they grow, providing an effective and stable chuck force on both upper and lower chucks throughout the winding cycle.

Precise fluid volume control in the primary hydraulic circuit is required to maintain chuck location relative to each other. This is accomplished with a system that is closed to its reservoir 54 by valves 56 yet has free fluid flow between cylinders 25,27 as yarn packages are wound. Each time completed yarn packages are doffed, the valves 56 are opened via pressure fed from line 72 via valve 80. Line air pressure is maintained on the hydraulic reservoir 54 at all times; that pressure is greater than the pressure in the hydraulic system. Therefore, when the valves 56 are opened, fluid is added to the system until the bottom cylinder 27 is stroked out and the upper cylinder shaft **25*a* joined to linear bearings 22,22*a* via support 18 is forced to move upward until bearings 22,22*a* contact previously set mechanical stops indicated at 75; when these conditions are met, the fluid volume in the primary hydraulic system is correct. Valves 56** are closed, following doffing of the packages, sealing the hydraulic system. This 'resetting' the fluid volume in the primary hydraulic system is repeated each doff cycle, effectively preventing long-term drift in chuck position.

I claim:

1. A yarn winding apparatus comprising:

a frame;

an elongated driven roll, said roll being cantilevered at one end to said frame along its major axis;

at least one pair of rotatable chucks, each chuck carrying a package support for engaging said driven roll as to be driven thereby;

a plurality of angularly displaced bearing posts mounted to said frame adjacent said one end of said driven roll;

a plurality of linear bearings mounted on said bearing posts for movement in angularly displaced planes, each said chuck being mounted to at least one of said bearings;

a hydraulic system comprising hydraulic cylinders having operating shafts at one end and a pressurized source of fluid connected to their other ends for driving said shafts, the shaft of one cylinder being connected to at least one bearing of one chuck while said one cylinder is fixed to said frame, the shaft of the other cylinder being connected to said frame, while said other cylinder is fixed to at least one bearing of the other chuck to move said chucks simultaneously toward and away from engagement with said driven roll in separate angularly displaced planes that intersect each other at the central axis of the drive roll;

means for traversing said yarn as it advances around the driven roll to the driven supports to form packages; and hydraulic circuit means connected between said hydraulic cylinders for replicating motion of one of said pair of chucks in the other of said pair of chucks during winding of said packages.

2. The apparatus of claim 1 including means for resetting the fluid volume in the hydraulic circuit means.

* * * * *